United States Patent [19]

Kaiser et al.

[11] Patent Number: 5,056,172

[45] Date of Patent: Oct. 15, 1991

[54] METHOD OF FOLDING A BEACH BLANKET

[76] Inventors: Richard Kaiser, 5761 Tuxedo Ter., Los Angeles, Calif. 90068; John T. Gutch, 16945 Sunset Blvd., Pacific Palisades, Calif. 90272; Richard Rasof, 7923 Agnes St., #5, North Hollywood, Calif. 91605

[21] Appl. No.: 557,318

[22] Filed: Jul. 23, 1990

Related U.S. Application Data

[62] Division of Ser. No. 452,636, Dec. 19, 1989, Pat. No. 4,951,333.

[51] Int. Cl.[5] ..... A47G 9/06

[52] U.S. Cl. ..... 5/417; 135/104

[58] Field of Search ..... 5/417-420; 135/104; 160/370.2, 377, DIG. 3

[56] References Cited

U.S. PATENT DOCUMENTS

| | | | |
|---|---|---|---|
| 2,190,566 | 2/1940 | Julian | 5/418 X |
| 3,960,161 | 6/1976 | Norman | 135/905 X |
| 3,990,463 | 11/1976 | Norman | 135/905 X |
| 4,512,049 | 4/1985 | Henry . | |
| 4,709,430 | 12/1987 | Nicoll . | |
| 4,815,784 | 3/1989 | Zheng . | |
| 4,821,353 | 4/1989 | Neri . | |
| 4,825,892 | 5/1989 | Norman | 135/905 X |
| 4,858,634 | 8/1989 | McLeese | 135/905 X |
| 4,951,333 | 8/1990 | Kaiser et al. | 5/417 |

*Primary Examiner*—Michael F. Trettel
*Attorney, Agent, or Firm*—Marvin E. Jacobs

[57] ABSTRACT

A self-supporting beach blanket having two layers of fabric joined at their edges with a single spring steel hoop inside sized to hold the blanket open and flat on the ground. The hoop is compressible so that it can be removed through a small slit in the side allowing the blanket to be machine washed.

8 Claims, 4 Drawing Sheets

METHOD OF FOLDING A BEACH BLANKET

This is a division of application Ser. No. 452,636, filed Dec. 19, 1989, U.S. Pat. No. 4,951,333.

BACKGROUND OF THE INVENTION

This invention relates to self-supporting ground covering devices in general and beach blankets in particular for providing protection from the ground when lying on the beach or the like. Wind and traffic will move the beach blanket undesirably. Providing some support to the blanket is handy to hold it in place and also to help move and shake the blanket clean.

STATEMENT OF THE PRIOR ART

Prior art support structures are typified by Nicoll U.S. Pat. No. 4,709,430 wherein a water filled plastic tube is secured in a perimeter pocket to provide weight and shape to a beach blanket. Such an arrangement does solve the problems of movability and stability but is disadvantageous in that the tube is permanently secured in place at manufacture and thus difficult to remove by the end user. Hence, the blanket is bulky to store and essentially impossible to wash easily as in a washing machine.

Another approach is shown by Henry U.S. Pat. No. 4,512,049 where spikes driven into the ground hold the blanket in place against wind and traffic. This design is easily washable but hard to use. Also the blanket cannot be easily moved or lifted to shake off sand and the like. Reference should also be had to Neri U.S. Pat. No. 4,821,353 which shows a beach mat with a supported sun shade. Neri is also subject to the disadvantages discussed above.

SUMMARY OF THE INVENTION

The present invention provides a self-supporting beach blanket which is stable in use and easily movable like Nicoll but also easily machine washable. Briefly, a pair of membranes of similar shape are joined to each other at the edges to form a closed two layer beach blanket. A single large flexible springy hoop is inserted through a small slit opening on the edge of the blanket and allowed to expand to the inside limits of the blanket edges. The shape of the blanket is thus stabilized against wind and traffic. Also the blanket is supported sufficiently that it can be easily picked up and moved or shaken clean. Proper design of the hoop permits it to be quickly removed through the small slit so the blanket can be readily machine washed. An additional synergistic benefit flows from the hoop design in that a single large hoop of the correct mechanical characteristics, restrained by the beach blanket against outward expansion is actually partially self folding. This remarkable result is very helpful in allowing the user to quickly store the blanket and permits the user to readily carry the blanket.

The use of a single large hoop as contemplated by this invention permits a novel method of folding wherein the center portion of the blanket is placed against the user's chest and the two sides are folded inward over the center portion of the blanket. Since the blanket is structurally stable, it holds its shape during the initial folds, being unable to spring away due to its rest position against the user's chest. The folding increases tension in the hoop, however, which tension causes the top and bottom of the hoop to move vertically toward each other thus completing the folding.

An additional improvement comprises an inflatable pillow which has a tab that can be inserted and secured in the small slit so as to join the pillow to the beach blanket and also nicely conceal the slit.

An interesting prior art reference from a non-analogous art that shows the unexpectedness of the self-folding feature is Zheng U.S. Pat. No. 4,815,784 in which multiple hoops are used inside a fabric windshield sun screen. Zheng teaches that two or more hoops are needed to support a flat fabric structure. The hoops are not removable and the sun screen is not intended to be washable, but still the need for multiple hoops is assumed by Zheng.

Additional advantages and benefits will become apparent to those skilled in the art upon consideration of the following more detailed description and drawings.

DETAILED DESCRIPTION OF THE PREFERRED EMBODIMENT

Figure 1:
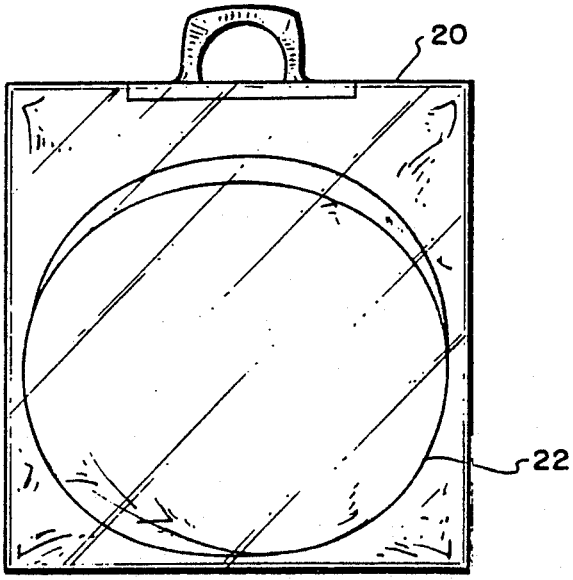
FIG. 1 shows the stored beach blanket in a transparent plastic container.
Figure 2:
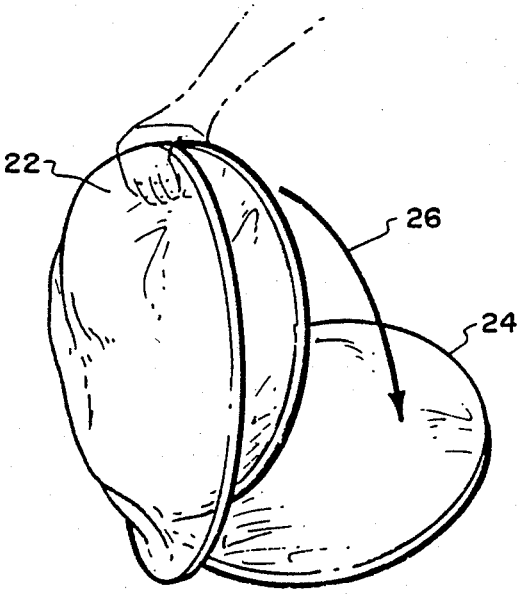
FIG. 2 shows the start of the unfolding of the blanket with the corresponding hoop configuration indicated in FIG. 3.
Figure 3:
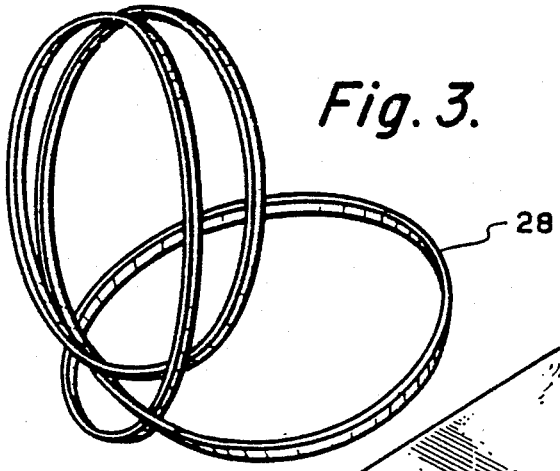

In FIG. 1, the present invention is shown in the stored configuration inside a transparent plastic bag 20. Beach blanket 22 is removed from bag 20, the reverse of the motion shown in FIG. 11, and allowed to swing open with the rear hoop 24 falling downward as shown by arrow 26 in FIG. 2. With the blanket extended to the position shown in FIG. 2, the internal flexible springy hoop 28 will be about as shown in FIG. 3.

Figure 4:
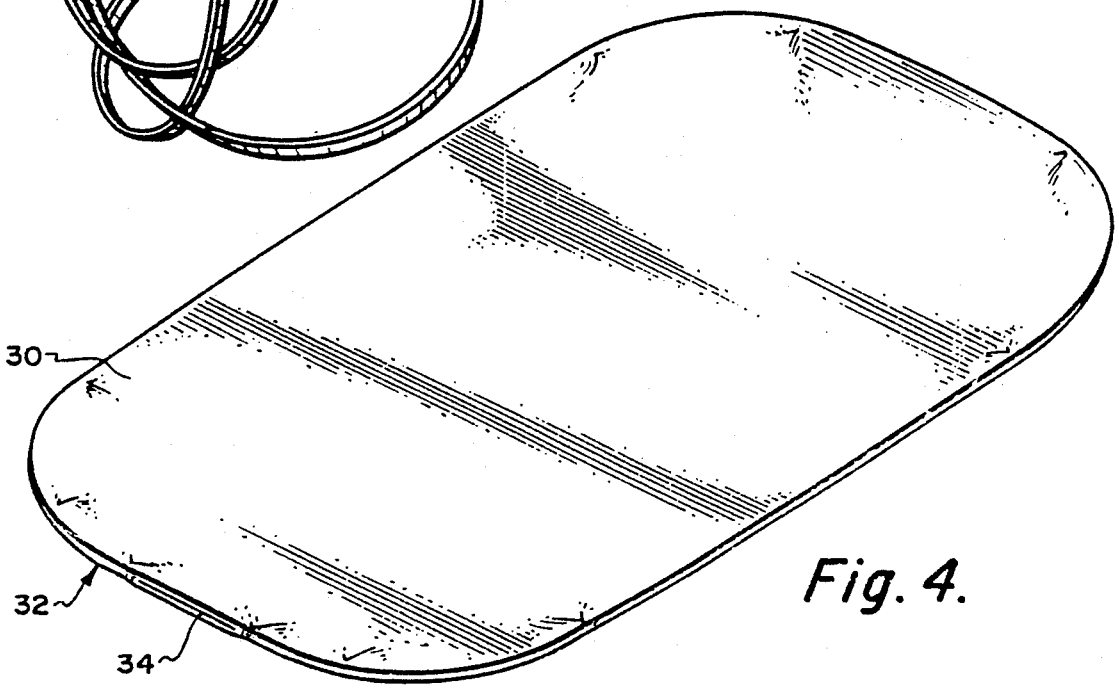
FIG. 4 has the blanket fully extended and stabilized.

Simply releasing the remaining two loops of the hoop 28 causes the blanket to expand under its own stored spring forces to the shape of FIG. 4. As shown in FIG. 4 the preferred embodiment comprises two layers or membranes 30 and 32 forming top and bottom usuable surfaces joined together at the edges. Membranes 30 and 32 may be any of a large number of washable materials such as nylon, polyester, rayon, acrylic, wool, cotton or neoprene as desired. The preferred material is a woven fabric such as cotton or cotton-polyester. The top and bottom membranes may differ. For example, the top membrane may be cotton-polyester and the bottom can be neoprene. The preferred shape is rectangular with well rounded corners although it will be obvious to those skilled in the art that the invention is equally applicable to circular, oval, or polygonal geometries provided that severe reentrant perimeter shapes are avoided. Even square shapes will work although sharp corners are not well filled by the naturally curving shape of hoop 28. Typical sizes include 20 by 40 inches, 45 by 70 inches, and 60 by 80 inches. These ranges of size have been found to work well with the springy hoop 28.

Hoop 28 comprises flexible spring steel in the preferred embodiment. Plastic or rubber like materials could be used for hoop 28, however, spring steel is not only reliable and less expensive, but its added weight helps hold the beach blanket in place on the ground. Hoop 28 can be formed with the ends joined with suitable clamps but the preferred embodiment uses welding to form a smooth strong joint. The thickness of hoop 28 is carefully chosen to provide the right balance of characteristics allowing easy removal through a slit 34 in the edge of blanket 22 but also providing spring forces adequate to shape blanket 22 and respond to the desired folding forces in the proper manner.

Figure 5:
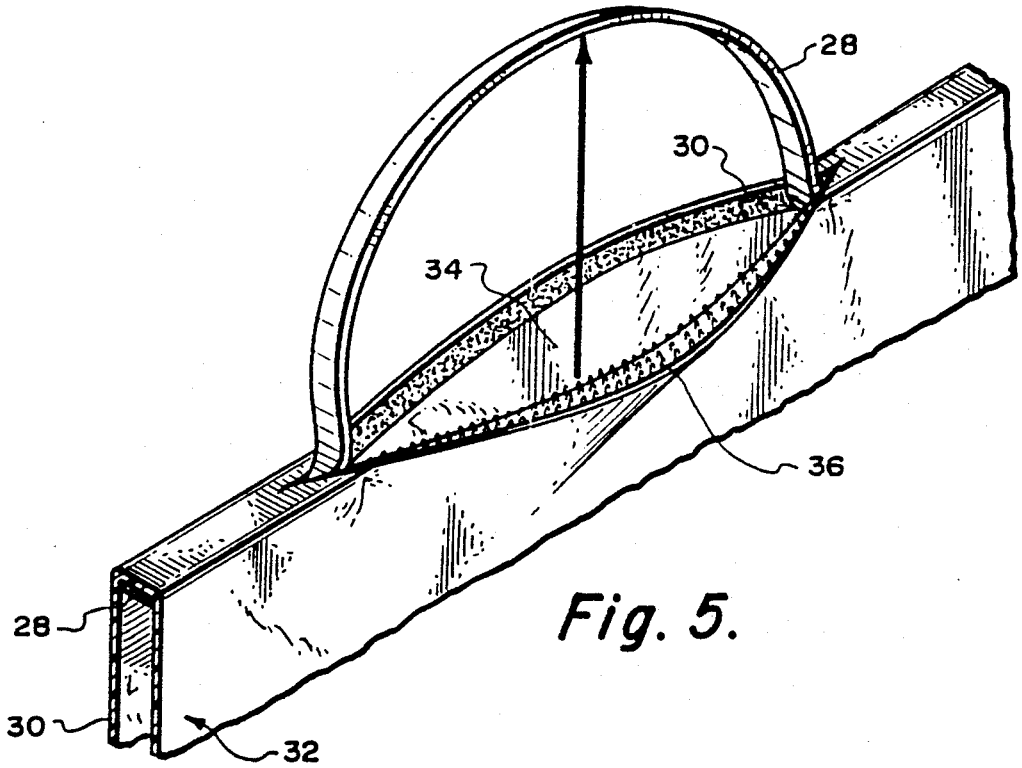
FIG. 5 shows how the hoop is removed through a small slit in the blanket.

Spring steel of one-sixteenth inch thickness and one quarter inch width has been found to offer a nice balance of behavior in the preferred embodiment. Such a hoop will readily compress to about 8 inches in diameter so as to permit easy removal through a slit 34 only 8"-12", suitably 10 inches long as shown in FIG. 5. Such a hoop also holds the blanket fully extended and provides an appropriate weight. Its folding characteristics, described hereinafter, are optimal as well. Larger widths have been used, for example three-eighths inch, which provide more weight and shape stability but are more difficult to extract through slit 34. Smaller widths, such as one-eighth inch, are also useful and easy to extract through slit 34 for washing although blanket shape is less reliably sustained thereby.

Keeping slit 34 short is desirable. Although buttons, hooks, zippers, snaps and the like may be used to secure slit 34, the preferred embodiment used a Velcro type loop and hook closure 36. Since hoop 28 exerts an outward force, a longer opening for slit 34 could permit hoop 38 to wedge through under its own force. A hoop of the proper tension, however, once expanded inside blanket 22, tends to span an appropriately short slit 34 producing minimal force on the slit fasteners. It should be noted that slit 34 comprises an opening constituting over only three to seven percent of the perimeter length of the above mentioned typical size blankets. Thus hoop 28 is normally easily contained in blanket 22 yet can be compressed for extraction as shown in FIG. 5.

Figure 6:
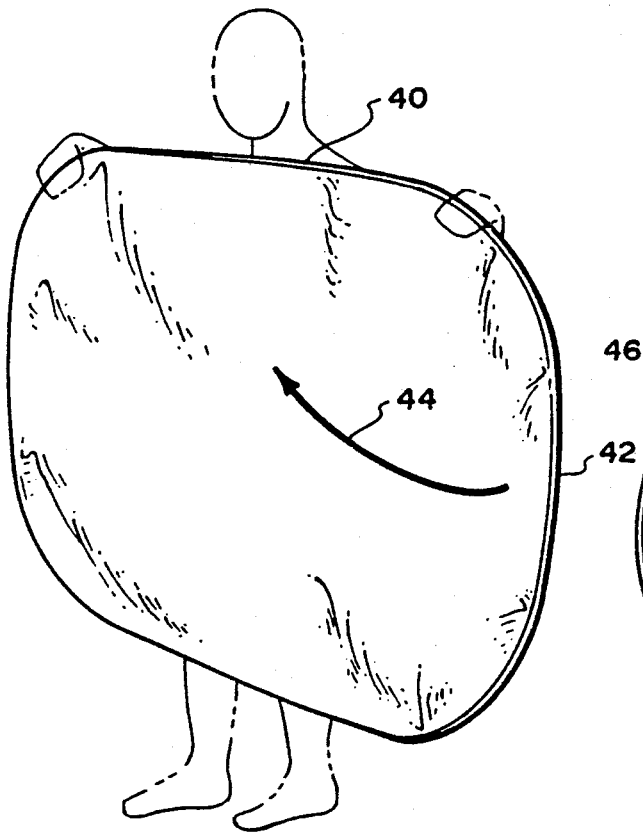
FIGS. 6, 7, 8, 9, 10 and 11 show sequentially the self-folding feature in steps.
Figure 7:
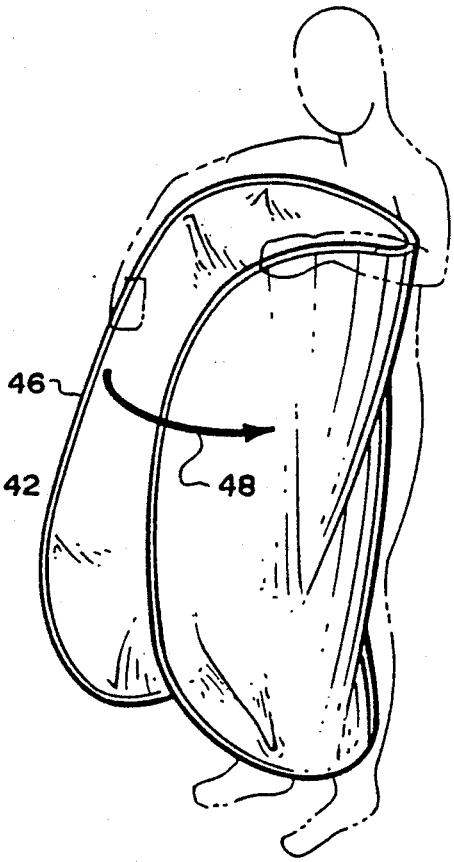
Figure 8:
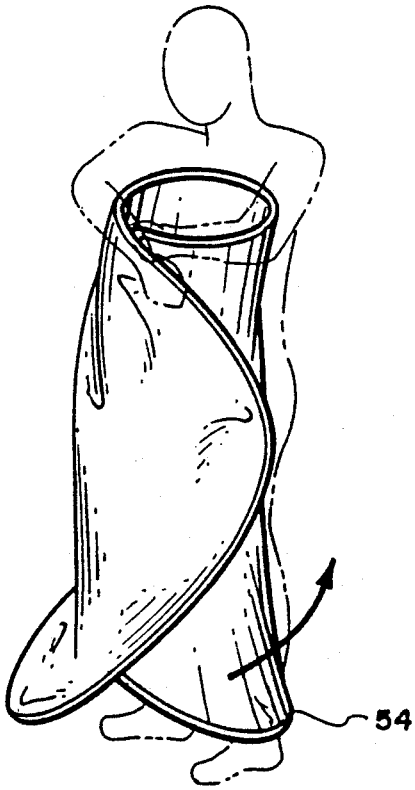
Figure 9:
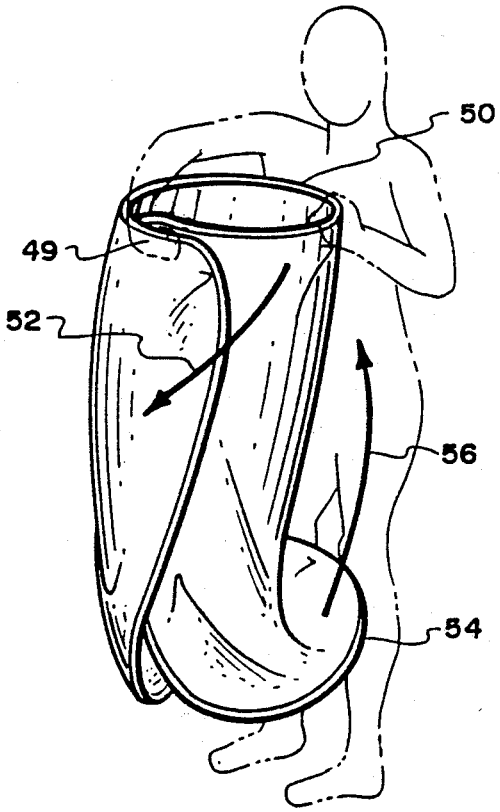
Figure 10:
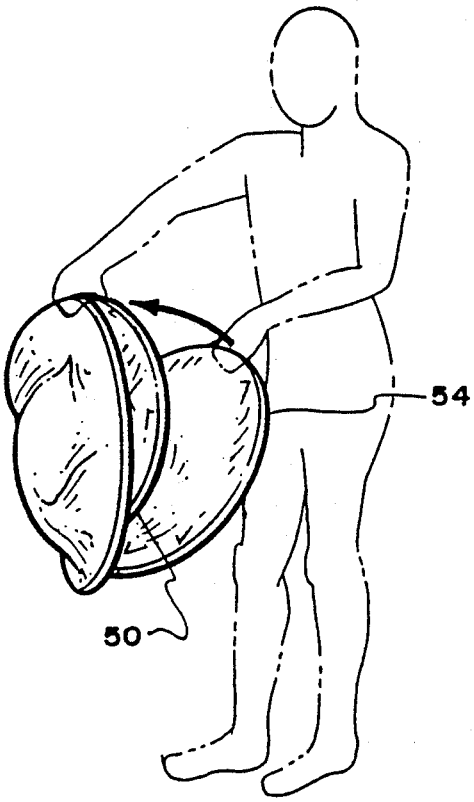
Figure 11:
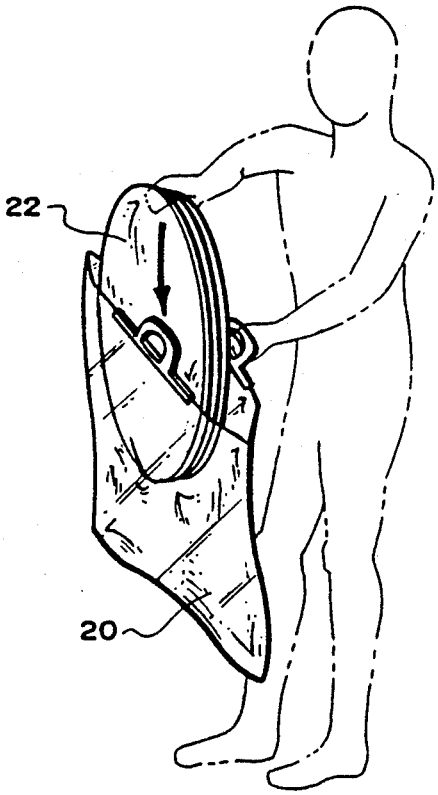

Hoop 28 also permits blanket 22 to be easily folded and stored. As shown in FIG. 6, the blanket is held against the chest at location 40. The left side 42 is folded inward as shown by arrow 44, while the right side 46 is also folded inward as shown by arrow 48 in FIG. 7 while the blanket is restrained from movement towards the user by the user's chest. Since hoop 28 is thereby additionally tensioned, but cannot escape outward because of the restraint of layers 30 and 32, it tends to spring into a saddle geometry once it reaches the position shown in FIG. 8. The two overlapped sides may be grasped together as with hand 49 in FIG. 9 and the blanket moved forward a bit so as to allow the top and bottom parts of the blanket to move vertically toward each other under their own impetus. Thus, the blanket folds itself with top loop 50 going downward along path 52 and bottom loop 54 rising along path 56 to the position shown in FIG. 10. The folded blanket is then easily reinserted in bag 20 as shown in FIG. 11.

Figure 12:
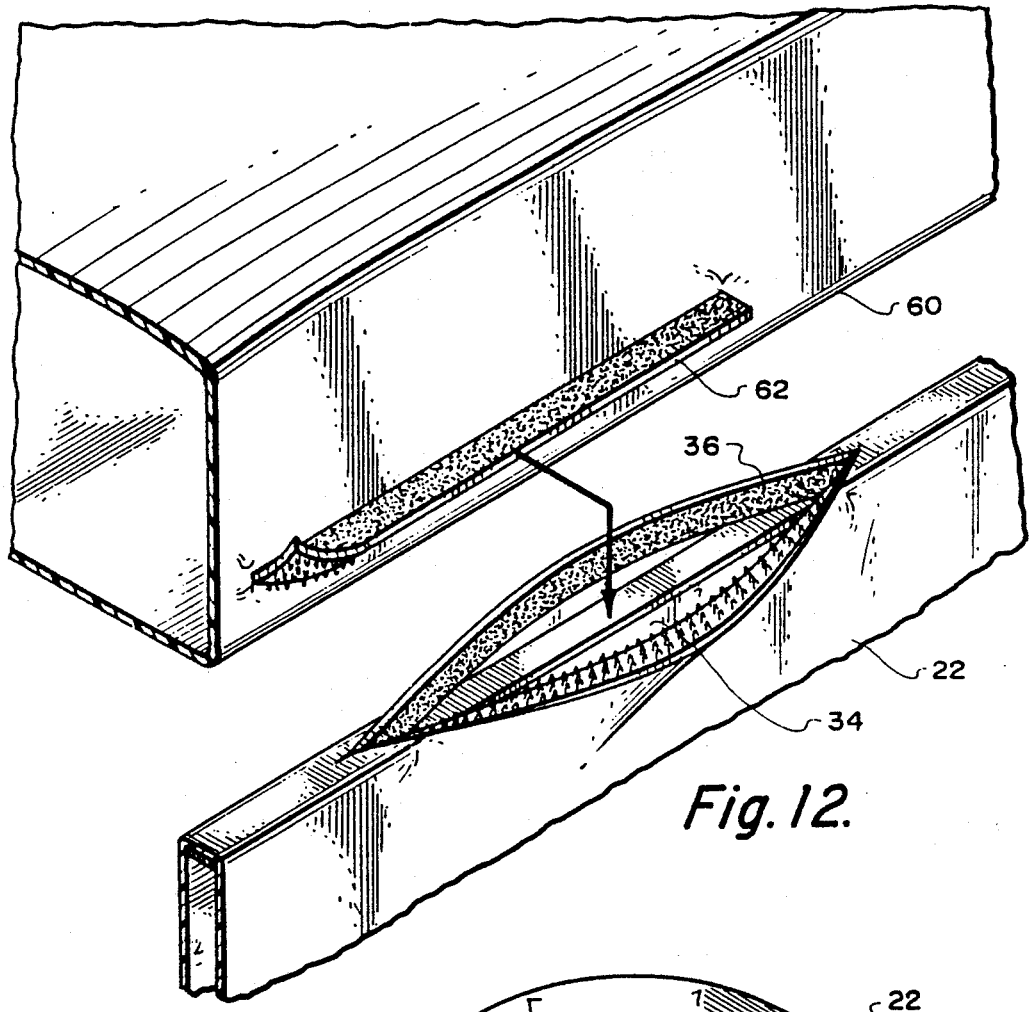
FIG. 12 shows how an inflatable pillow can be mounted in the small slit.
Figure 13:
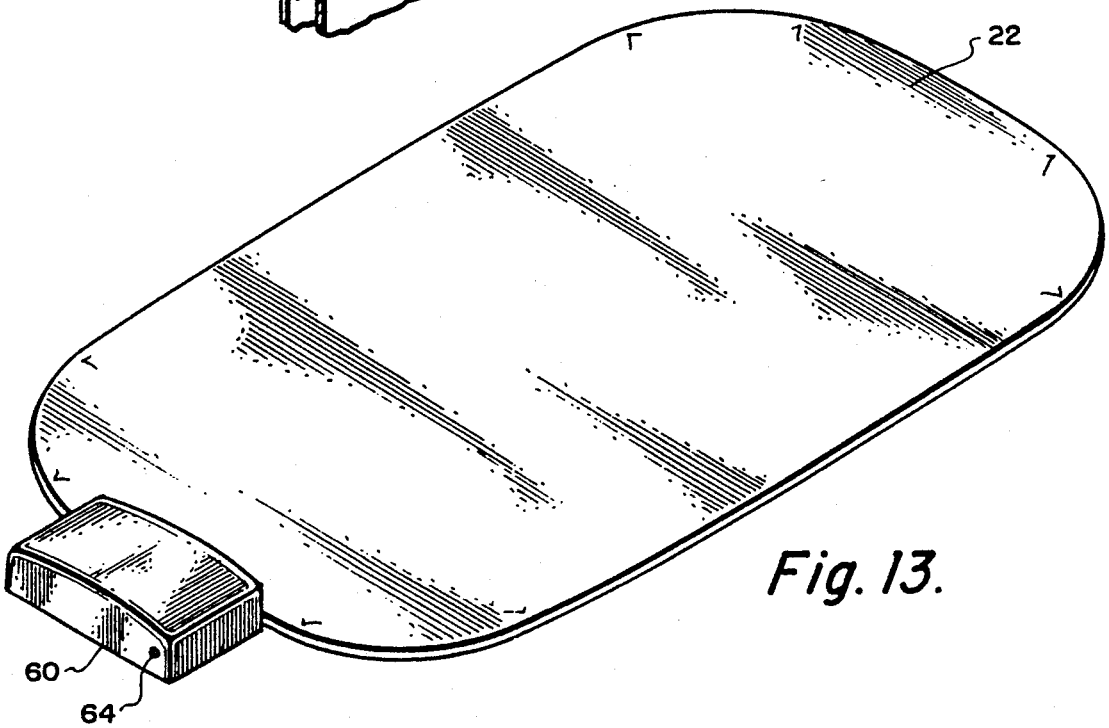
FIG. 13 shows the assembled pillow and beach blanket.

Referring to FIGS. 12 and 13, the present invention contemplates also an inflatable pillow 60 having a tab 62 affixed to one side. Tab 62 is insertable into slit 34 and secured in place by the closing means chosen for slit 34. In the preferred embodiment, a Velcro type loop and hook tab 62 is utilized to engage the Velcro closure 36. The pillow 60 has a valve 64 for use in inflating and deflating the pillow 60.

It will be obvious to those skilled in the art that additional modifications may be made in addition to those described above and therefore I intend to be limited only by the appended claims.

We claim:

1. A method of folding a beach blanket with peripherally attached dual layers defining a center portion, a left end, and a right end with a flexible spring support hoop between the layers retained against the blanker periphery comprising the steps of:

supporting the center portion of the blanket against a user's chest;

folding the left and right ends of the blanket first forward and then inward over the center portion of the blanket to form top and bottom portions while restraining the center portion from movement toward the user by the chest support; and moving the partially folded blanket forward so as to allow the top and bottom portions of the blanket to move vertically together under spring tension caused by the support hoop into a folded configuration.

2. A method of folding a beach blanket having a center portion, a left end, and a right end bounded by the perimeter formed by a flexible spring support hoop retained against a fold formed in the peripheral edge of the beach blanket comprising the steps of:

supporting the center portion of a blanket against the user's chest;

first folding the left and right ends of the blanket forward and then inward over the center portion of the blanket to form top and bottom portions while restraining the center portion from movement toward the user by the chest support; and moving the partially folded blanket forward so as to allow the top and bottom portions of the blanket to move vertically together under spring tension caused by the support hoop into a folded configuration.

3. A method according to claim 2 in which the beach blanket is rectangular.

4. The method according to claim 2 in which said hoop comprises a spring material sufficiently strong to expand outward against said peripheral edge with a force such that folding the blanket in one direction causes said hoop to further fold itself perpendicular to said direction.

5. The method according to claim 4 in which said hoop is formed from a spring steel material.

6. The method according to claim 5 in which said hoop has a width in the range of one-eighth to three-eighth inch and a thickness of about one-sixteenth inch.

7. The method according to claim 2 in which said hoop is formed from a spring steel material.

8. The method according to claim 7 in which said spring steel hoop has a width of about one-fourth inch and a thickness of about one-sixteenth inch.

* * * * *